US006338207B1

(12) United States Patent
Chang

(10) Patent No.: US 6,338,207 B1
(45) Date of Patent: Jan. 15, 2002

(54) SOLE AND PRESSURE-BUFFER INSERT ARRANGEMENT SPORTS SHOE

(76) Inventor: Kuei-Lin Chang, No. 10, Alley 6, Lane 100, Tong Kwang Yuan Rd., East District, Taichung (TW)

( * ) Notice: Subject to any disclaimer, the term of this patent is extended or adjusted under 35 U.S.C. 154(b) by 0 days.

(21) Appl. No.: 09/713,267

(22) Filed: Nov. 16, 2000

(51) Int. Cl.[7] ..... A43B 13/20; A43B 13/18

(52) U.S. Cl. ..... 36/29; 36/28; 36/35 B; 36/31

(58) Field of Search ..... 36/25 R, 28, 29, 36/31, 114, 88, 136, 35 R, 36 R, 35 B

(56) References Cited

U.S. PATENT DOCUMENTS 1,011,460 A * 12/1911 Maddocks ..... 36/29
1,506,975 A * 9/1924 Cooney ..... 36/29
2,682,712 A * 7/1954 Owsen et al. ..... 36/29
4,573,279 A * 3/1986 Feurer-zogel et al. ..... 36/35 R
4,624,061 A * 11/1986 Wezel et al. ..... 36/31
4,779,359 A * 10/1988 Famolare, Jr. ..... 36/29
5,212,878 A * 5/1993 Burke et al. ..... 36/28
5,343,639 A * 9/1994 Kilgore et al. ..... 36/29

* cited by examiner

*Primary Examiner*—M. D. Patterson
(74) *Attorney, Agent, or Firm*—Varndell & Varndell, PLLC

(57) ABSTRACT

A sole and pressure-buffer insert arrangement is disclosed includes a pressure-buffer insert inserted into a side opening in the sole of a shoe, the pressure-buffer insert including two linked elastic shells, and two inflatable air bag respectively inserted into the shells from one side, each inflatable air bags each having an air valve exposed outside the sole of the shoe for input/output of air pressure.

1 Claim, 3 Drawing Sheets

SOLE AND PRESSURE-BUFFER INSERT ARRANGEMENT SPORTS SHOE

BACKGROUND AND SUMMARY OF THE INVENTION

The present invention relates to sports shoes and, more specifically, to a pressure-buffer insert adapted for inserting into the sole of a sports shoe to buffer the pressure of the sole of the user wearing the sports shoe.

In order to absorb shocks and reinforce the springy power of shorts shoes, sports shoe manufacturers may install air cushion means, oil bag means, and the like in the insole at locations corresponding to the ball of the foot or the heel. Because some of the material may leak when overheated, it does not meet environment protection requirements.

It is the main object of the present invention to provide a sole and pressure-buffer insert arrangement for sports shoe, which effectively buffers the pressure from the sole of the user wearing the sports shoe. It is another object of the present invention to provide a sole and pressure-buffer insert arrangement for sports shoe, which uses linked shells to hold two inflatable air bags at locations corresponding to the ball of the foot and the heel for buffering the pressure of the sole of the user wearing the sports shoe. It is still another aspect of the present invention to provide a sole and pressure-buffer insert arrangement for sports shoe, which allows the user to adjust the air pressure of the inflatable air bags conveniently.

DETAILED DESCRIPTION OF THE PREFERRED EMBODIMENT

Referring to Figures from 1 through 3, a pressure-buffer insert is transversely inserted into a side opening in the sole

Figure 1:
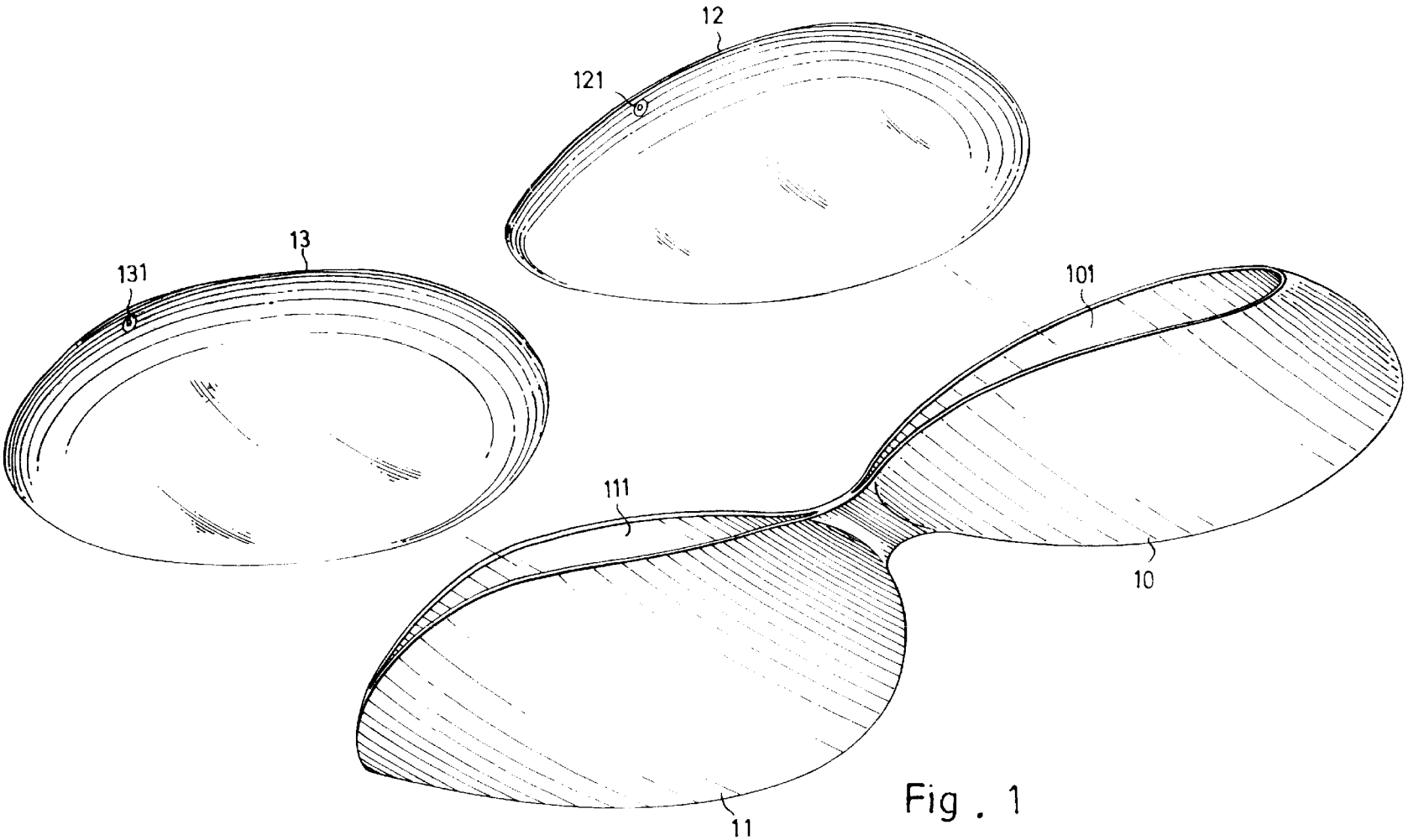
FIG. 1 is an exploded view of a pressure-buffer insert according to the present invention.
Figure 2:
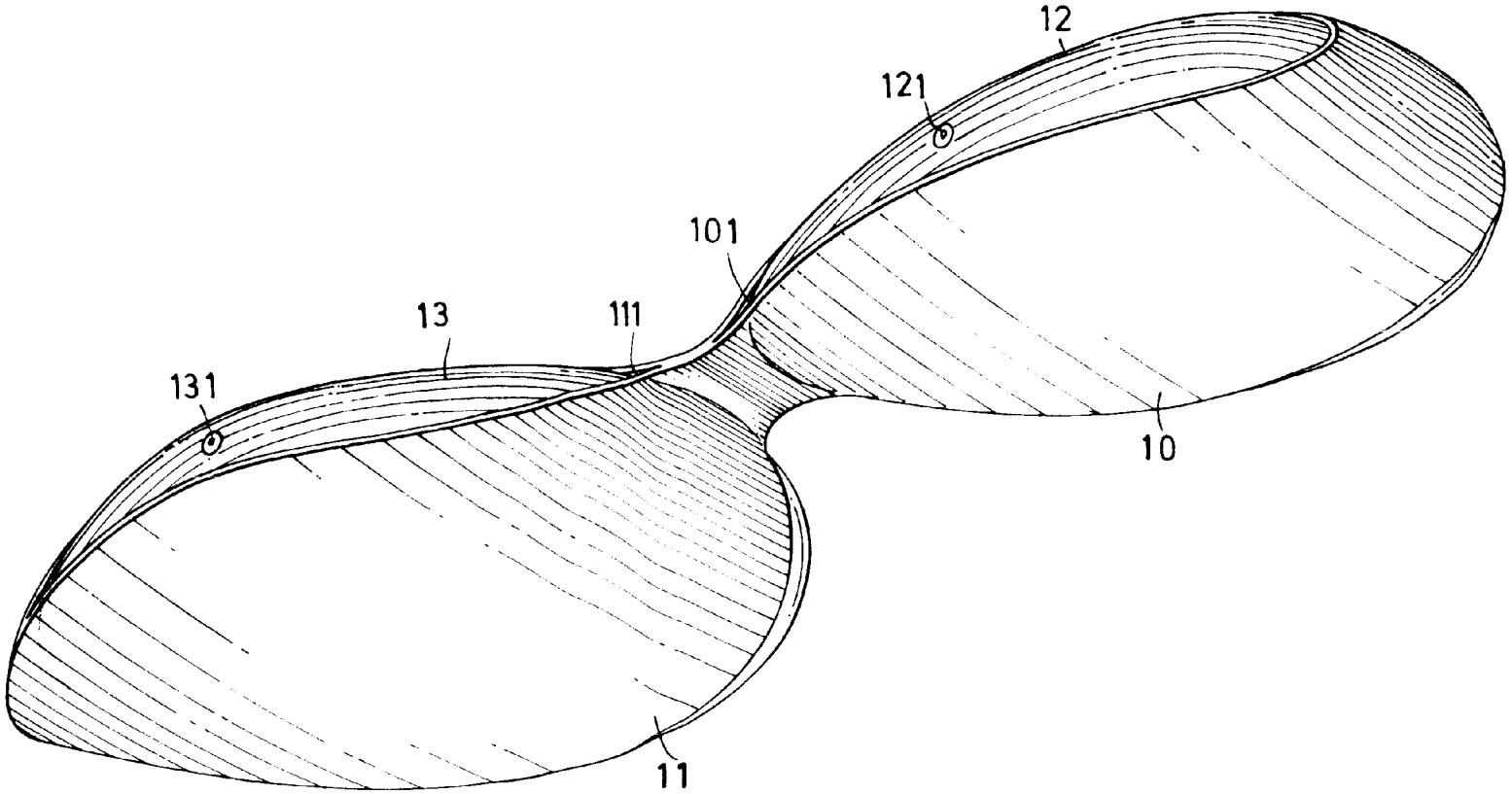
FIG. 2 is an assembly view of the pressure-buffer insert shown in FIG. 1.
Figure 3:
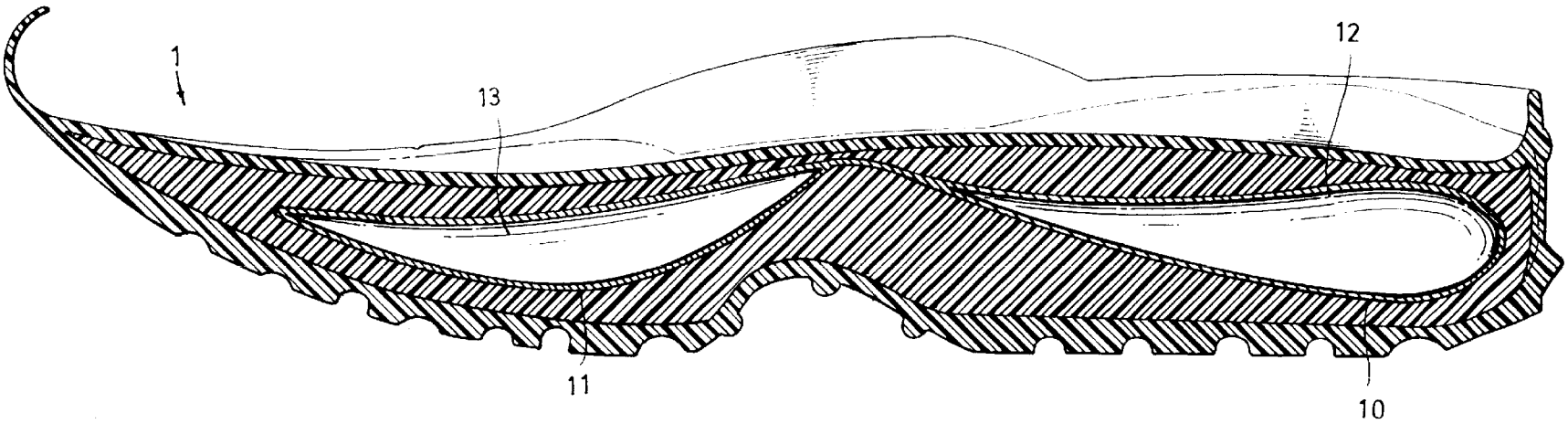
FIG. 3 is a sectional view showing the pressure-buffer insert installed in the sole of a sports shoe according to the present invention.

1 of a sports shoe to buffer the pressure from the sole of the user wearing the sports shoe. The pressure-buffer insert, as shown in FIG. 1, is comprised of two linked shells 10 and 11, and two inflatable air bags 12 and 13. The linked shells 10 and 11 are made of elastic material in integrity, defining a respective side-open receiving chamber 101 and 111. The inflatable air bags 12 and 13 are respectively inserted into the side-open receiving chambers 101 and 111 of the shells 10 and 11, each having an air valve 121 or 131 disposed at one lateral side. After installation of the pressure-buffer insert in the side opening in the sole 1, the air valves 121 and 131 are exposed to the outside. Through the air valves 121 and 131, air is driven into the inflatable air bags 12 and 13 to inflate the inflatable air bags 12 and 13 to the desired inflated status. When the user walks or runs, the pressure-buffer insert is continuously compressed and released to buffer the pressure from the sole of the user.

As stated above, the air valves 121 and 131 of the air bags 12 and 13 are exposed to the outside of the sole 1, the user can adjust the inflated status of the inflatable air bags 12 and 13 conveniently.

While only one embodiment of the present invention has been shown and described, it will be understood that various modifications and changes could be made thereunto without departing from the spirit and scope of the invention disclosed.

I claim:

1. A sole and pressure-buffer insert arrangement comprising a pressure-buffer insert inserted into a side opening in the sole of a shoe and adapted to buffer the pressure from the sole of the user wearing the shoe, said pressure-buffer insert comprising two linked elastic shells, said shells each defining a side-open receiving chamber, and two inflatable air bag respectively inserted into the side-open receiving chambers of said shells, said inflatable air bags each having an air valve exposed to the outside of the sole of the shoe for input/output of air.

* * * * *